United States Patent [19]

Riefel et al.

[11] 4,386,891

[45] Jun. 7, 1983

[54] ROTARY HYDRAULIC VANE PUMP WITH UNDERVANE PASSAGES FOR PRIMING

[75] Inventors: Richard P. Riefel, Saginaw; John G. Henne, Frankenmuth; David A. Dean, Saginaw, all of Mich.

[73] Assignee: General Motors Corporation, Detroit, Mich.

[21] Appl. No.: 256,722

[22] Filed: Apr. 23, 1981

[51] Int. Cl.[3] ..... F04C 2/00; F04C 15/00

[52] U.S. Cl. ..... 418/81; 418/82; 418/269

[58] Field of Search ..... 418/81, 82, 267, 268, 418/269

[56] References Cited

U.S. PATENT DOCUMENTS 3,598,510 8/1971 Aoki ..... 418/82

3,973,881 8/1976 Melchinger ..... 418/82

FOREIGN PATENT DOCUMENTS 2835816 2/1980 Fed. Rep. of Germany ..... 418/269

*Primary Examiner*—John J. Vrablik

*Attorney, Agent, or Firm*—Donald F. Scherer

[57] ABSTRACT

A balanced vane type hydraulic pump has a thrust plate and a pressure plate which cooperate with a cam ring, rotor and vanes to provide a plurality of pump chambers. During pump operation, fluid trapped under the vanes flows from under the vanes at the discharge port, as the vane recedes, to under the vanes at the inlet port to assist vane extension and improve pump priming. The undervane fluid passes through grooves in both plates with the groove in the pressure plate being in communication with the discharge flow of the pump. The grooves incorporate restrictions to the undervane fluid flow between the discharge and inlet positions of the vanes with the restriction in the thrust plate permitting more fluid flow than the restriction in the pressure plate to ensure that most of the fluid will pass through the rotor under the vanes in the inlet position to assist in vane extension.

2 Claims, 2 Drawing Figures

ROTARY HYDRAULIC VANE PUMP WITH UNDERVANE PASSAGES FOR PRIMING

This invention relates to hydraulic vane type pumps and more particularly to such pumps having undervane pressure to assist vane extension.

Prior art power steering pumps have provided an exclusive flow path for the undervane fluid in a balanced vane type pump to improve cold-priming. This exclusive flow path is from under the vanes in the pressure or discharge quadrant through a groove in the thrust plate to under the vanes in the inlet quadrant. The pressure plate has a groove in the inlet quadrant which communicates the undervane fluid in the inlet quadrant with the discharge flow of the pump. While this structure provides fast priming, it also induces high undervane pressure when the system operating temperature is at the normal level and the pump is operating within the normal speed range. The high undervane pressure can induce early wear and reduces the overall life of the pump.

The present invention provides a pressure assist to vane extension thus improving pump priming without having abnormally high undervane pressure at normal operating temperatures. This pressure assist is provided by a restricted flow passage for the undervane fluid in the pressure plate which is in parallel flow relation to a restricted passage in the thrust plate. The restricted flow passage in the pressure plate has a flow area that is between 15 and 23% of the flow area in the thrust plate.

At low temperatures, the restricted passage in the pressure plate is sufficient to induce most of the undervane fluid to flow through the passage in the thrust plate from which it is communicated to the underside of the vanes in the inlet quadrant so that an assist to vane extension is present. At normal operating temperatures, there is sufficient flow through the restricted passage in the pressure plate to prevent the undervane pressure in the discharge quadrant from exceeding the discharge pressure of the pump by a significant amount.

It is therefore an object of this invention to provide an improved cold-start priming in a balanced vane pump wherein parallel flow paths of unequal restriction are established for the undervane fluid flow whereby most of the undervane fluid must pass under the vanes in the inlet quadrant before communicating with the pump discharge flow thereby assisting vane extension.

This and other objects and advantages of the present invention will be more apparent from the following description and drawings in which.

Figure 1:
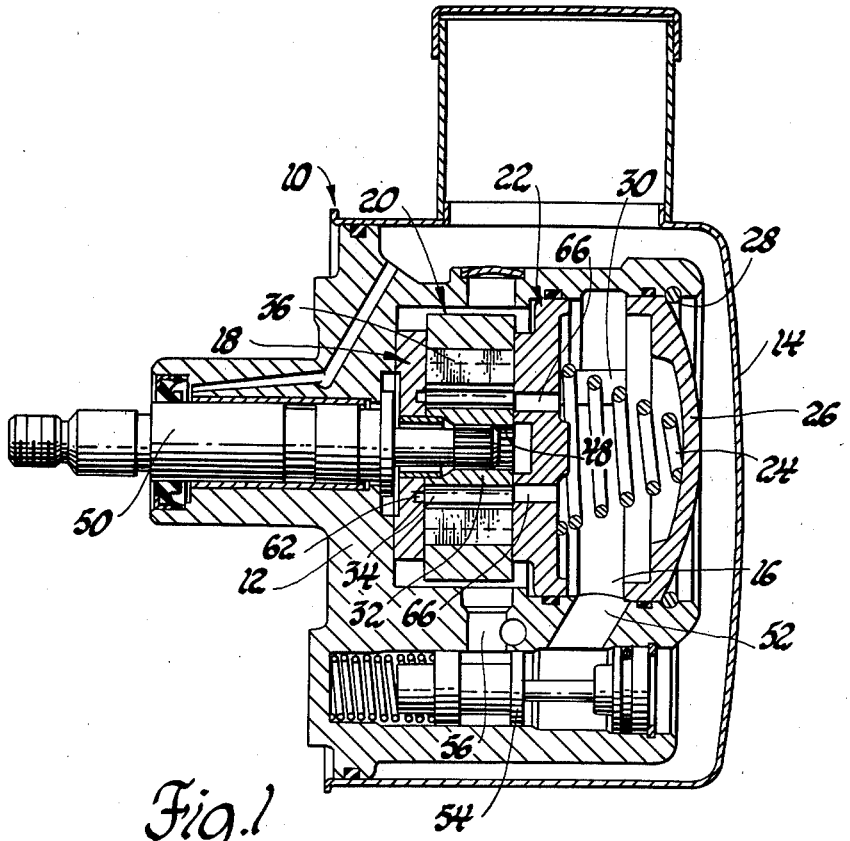
FIG. 1 is a cross-sectional elevational view of a power steering pump.

Referring to the drawings, there is seen in FIG. 1 a power steering pump, generally designated 10, including a housing 12 and an attached reservoir covering 14. The housing 12 has a substantially cylindrical inner space 16 in which is disposed a thrust plate 18, a cam ring 20, a pressure plate 22, a hold-down spring 24 and an end cap 26. The end cap 26 is restrained in the housing by a locking ring 28. The thrust plate 18, the cam ring 20 and the pressure plate 22 are maintained in axial and angular alignment by a pair of dowel pins 30 which extend from openings (not shown) in the housing 12 to the end cap 26.

The cam ring 20 has rotatably disposed therein a rotor 32 having a plurality of vane slots 34. Each vane slot 34 has slidably disposed therein a vane member 36 which is adapted to move radially outward to abut the inner surface of cam ring 20 such that a fluid chamber is formed between adjacent vane members 36.

Figure 2:
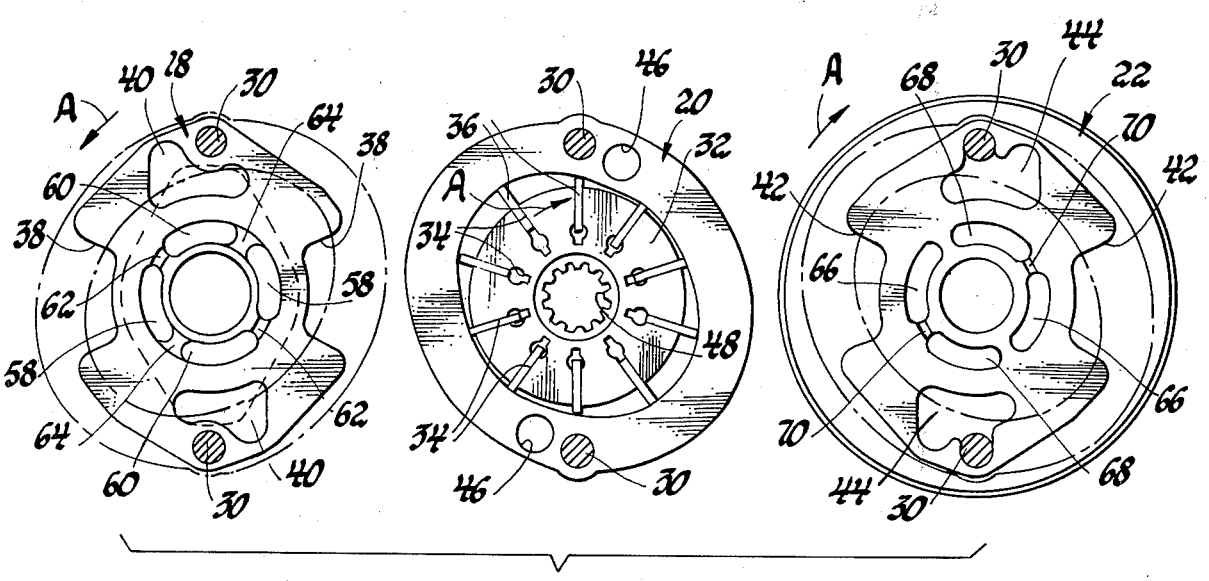
FIG. 2 is a view showing the relative disposition of some of the pump parts.

As seen in FIG. 2, each vane slot 34 is of sufficient inward radial extent that there is space available for fluid under the vane also. The thrust plate 18 and pressure plate 22 cooperate with the rotor and cam ring to define the axial extent of the fluid chambers formed between adjacent vane members 36. The thrust plate 18 has a pair of diametrically opposed inlet ports 38 and a pair of diametrically opposed discharge ports 40. The discharge ports 40 are recess ports only and do not extend entirely through the width of the thrust plate 18.

The pressure plate 22 has a pair of diametrically opposed inlet ports 42 which are axially aligned with the inlet ports 38 and diametrically opposed discharge ports 44 which are axially aligned with the discharge ports 40. The discharge ports 40 and 44 are also in fluid communication through a pair of cylindrical apertures 46 which are formed in the cam ring 20.

The hold-down spring 24 creates a sufficient force to maintain the pressure plate 22, cam ring 20 and thrust plate 18 in the abutting relationship shown in FIG. 1. The rotor 20 has a central spline portion 48 which is drivingly connected to a drive shaft 50 adapted to be driven by a prime mover such as an internal combustion engine.

When the drive shaft 50 is rotated, the chambers between adjacent vanes 36 will expand and contract in a well-known manner such that fluid will enter between adjacent vanes 36 when aligned with ports 38 and 42 and will be discharged when adjacent vanes are aligned with ports 40 and 44. The ports 44 are open to the space between thrust plate 22 and end cap 26. Fluid in this space is discharged through a passage 52 to a conventional flow control and pressure regulator valve 54 which permits a predetermined amount of fluid to be delivered from the pump to a discharge port, not shown, while the remainder of the fluid returns to the inlet ports 38 and 42 through a passage 56. The operation of flow control valve 54 is wellknown. However, should a more complete description be desired, it can be found in U.S. Pat. No. 3,207,077, Zeigler et al., issued Sept. 21, 1965. The pump shown in the Zeigler et al patent is substantially the same as the pump structure described above.

The fluid disposed in the vane slots 34 on the underside of the vane also undergoes a pumping action. The fluid under the vanes in the discharge quadrant, that is, the vanes passing through ports 40 and 44, is forced from under the vanes because the vanes 36 are receding into the slots 34. Simultaneously, the vanes in the inlet quadrant are extending thereby providing a space which must be filled with fluid. To communicate the fluid from under the vane in the discharge quadrant to under the vane in the inlet quadrant, fluid passages in both the thrust plate 18 and pressure plate 22 are provided. As seen in FIG. 2, the passage in thrust plate 18 has two substantially kidney-shaped passages 58 radially aligned with the inlet ports 38 and a pair of kidney-shaped passages 60 radially aligned with the discharge ports 40. These passages 58 and 60 are axially aligned with the radially inner ends of slots 34.

In the direction of pump rotation, designated by Arrow A, adjacent passages 60 and 58 are connected by restriction passages 62. In the direction opposite to pump rotation, adjacent passages 58 and 60 are connected by flow paths 64 which have substantially larger cross-sectional areas than the restrictions 62. The pressure plate 22 has a pair of kidney-shaped passages 66 substantially aligned with the inlet ports 42 and a pair of kidney-shaped passages 68 substantially aligned with the discharge ports 44. The passages 66 and 68 are axially aligned with the radial inner extent of slots 34.

In the direction of pump rotation designated by Arrow A, each respective passage 68 is in fluid communication with a respective adjacent passage 66 through a restricted passage 70. The restricted passage 70 has between 15 and 23% of the flow area of restricted passage 62. In a direction opposite to pump rotation, the adjacent passages 68 and 66 are not in fluid communication.

As seen in FIG. 1, the passages 66 extend through the width of pressure plate 22 and are accordingly, in fluid communication with the space between pressure plate 22 and end cap 26 in which fluid discharge flow from the pump is present prior to flowing through valve 54.

When the pump 10 has been at rest for a period of time and the ambient temperatures are moderately to extremely cold, it is possible that the pump will not prime quickly at speeds consistent with the idle speed of the engine without some pressure assistance for vane extension in the inlet quadrant. Also, when the pump is at rest, the vanes above the horizontal centerline of the pump have a tendency to recede in their respective vane slots while the vanes below the horizontal centerline have a tendency to be extended in the end vane slots due to gravitational forces.

Thus, upon start-up, at least half of the vanes are in an operating condition. The operating vanes in the pressure or discharge quadrant will recede in their respective vane slots and force the undervane fluid to pass into the kidney-shaped passages 60 and 68. The fluid in passages 68 meets with substantial flow resistance due to the restriction 70 while the fluid in passages 60 faces substantially less resistance. Therefore, most of the undervane fluid will be communicated from passages 60 to passages 58. From passages 58 the fluid must pass through the vane slots under the respective vanes to passages 66. The flow of fluid under the vanes in the inlet quadrant will cause vane extension thereby inducing the pump to be primed quite rapidly. A small amount of fluid will pass through the restricted passages 70 and will not provide any vane extension assist.

When the pump 10 is operating at normal temperatures, the fluid viscosity will decrease considerably from the cold-start condition such that fluid flow through restricted passages 70 will increase. Therefore, at normal operating temperatures, the undervane fluid has two passages through which it can communicate from the discharge quadrant to the inlet quadrant. This will prevent the undervane pressures from increasing an abnormal amount above the pressure in the pump discharge flow. Since the undervane pressures at normal operating temperatures are not excessively high, the pump durability is relatively unaffected by the slight increase in undervane pressure. However, at cold-start up temperatures, pump priming is improved because of the pressure assist given to the vane extension in the inlet quadrant.

If the restricted passage 70 were not present, pump priming time would be reduced slightly. Since all of the undervane fluid would pass from passage 60 to passage 58, the pressure required to move the undervane fluid through this exclusive passage could prove to be inducing high loading on the tips of the vanes at the cam surfaces such that premature wear might exist. This premature wear could reduce the overall life of the pump. The holddown spring 24 must be of sufficient force to overcome the difference between the maximum pressure which can exist between the left and right sides of pressure plate 22. Higher undervane pressures result in a higher force in spring 24.

As pointed out above, the use of restriction 70 reduces the likelihood of excessively high undervane pressures and, by properly sizing the restriction, ensures pump priming during start-up at low ambient temperatures.

The embodiments of the invention in which an exclusive property or privilege is claimed are defined as follows:

1. An improvement in self-priming, pressure balanced sliding vane pumps having a ported pressure plate and a ported thrust plate with passage means in each plate being axially aligned with the undervane cavities formed in the pump rotor, wherein the improvement comprises; said passage means in the thrust plate comprising two kidney-shaped passage means each of which extend the arcuate distance of adjacent ports and said kidney-shaped passage means being joined by a pair of restricted passages of predetermined flow area for accommodating undervane flow; and said passage means in said pressure plate comprising four kidney-shaped passages each aligned with respective ports and a pair of restricted passages joining adjacent kidney-shaped passages for flow from under the outlet port to under the inlet port in the direction of pump rotation and said restricted passages having a flow area of 15 to 23% of the restricted passages in said thrust plate to permit a small amount of fluid flow to bypass the passage means in said thrust plate.

2. A self-priming pressure balanced sliding vane pump comprising: a housing; a rotor member having a plurality of vane slots formed therein, a vane slidably disposed in each vane slot; a cam ring surrounding said rotor and cooperating with said rotor and said vanes to form a plurality of expandable chambers which expand as the vanes move radially outward and contract as the vanes move radially inward twice during each revolution of the rotor; a thrust plate disposed in said housing closing one axial end of said chambers and having a pair of diametrically opposed inlet ports, a pair of diametrically opposed outlet ports and a pair of kidney-shaped passage means axially aligned with the radial inner end of the vane slots, each kidney-shaped passage means extending for substantially the arcuate distance of adjacent inlet and outlet ports when viewed in the direction of pumping rotation for communicating fluid flow from cavities under the outwardly moving vanes to assist in vane extension during starting and a pair of restricted passages having a predetermined flow area connecting the kidney-shaped passage means; a pressure plate disposed in said housing closing the other axial end of said chambers and having a pair of inlet ports axially aligned with the thrust plate inlet ports, a pair of outlet ports axially aligned with the thrust plate outlet ports, four kidney-shaped passages formed for substantially the arcuate distance of respective ones of the ports in said pressure plate and aligned with the radial inner end of the vane slots, the kidney-shaped passages aligned with the inlet ports extending through said pressure plate, and a pair of restricted passages each having 15 to 23% of the flow area of the restricted passages in said thrust plate and extending from respective kidney-shaped passages aligned with said outlet ports to respective kidney-shaped passages aligned with said inlet ports when viewed in the direction of pump rotation, said kidney-shaped passages in said pressure plate accommodating a small volume of fluid flow from cavities under the inwardly moving vanes in bypass relation with the under-vane cavities of the outwardly moving vanes.

* * * * *